US005529875A

United States Patent [19]

Russell

[11] Patent Number: 5,529,875

[45] Date of Patent: Jun. 25, 1996

[54] CAGE COMPLEXES FOR CHARGE DIRECTION IN LIQUID TONERS

[75] Inventor: Dale D. Russell, Boise, Id.

[73] Assignee: Hewlett-Packard Company, Palo Alto, Calif.

[21] Appl. No.: 424,699

[22] Filed: Apr. 19, 1995

Related U.S. Application Data

[62] Division of Ser. No. 345,144, Nov. 28, 1994.

[51] Int. Cl.[6] ..... G03G 9/135

[52] U.S. Cl. ..... 430/137

[58] Field of Search ..... 430/109, 110, 430/115, 137

[56] References Cited

U.S. PATENT DOCUMENTS

| | | | |
|---|---|---|---|
| 4,564,574 | 1/1986 | Uytterhoeven et al. | 430/115 |
| 4,639,404 | 1/1987 | Uytterhoeven et al. | 430/115 |
| 5,393,635 | 2/1995 | Russell et al. | 430/115 |
| 5,411,833 | 5/1995 | Swidler | 430/137 |

*Primary Examiner*—John Goodrow

[57] ABSTRACT

Disclosed are negatively and positively charged liquid toners for eleotrophotography (EP). The charge on the toner particle is obtained by adding cage complex molecules, or clathrates/cryptates, to the liquid toner. The cage complex molecules have at least three chains, with a least one electron pair donor atom in each chain, for a total of at least three electron pair donor atoms (EPD's). Or, the cage complex molecules have at least two connected rings, with a total of at least three EPD's in the molecule including at least one EPD in each of the connected rings. For negatively charged toner particles, the clathrates/cryptates are distributed in the liquid dispersion, and metal cations are weakly associated with anionic functional groups on the toner particle. This way, the clathrates/cryptates in dispersion complex selectively with the cations and strip them from the toner particle, leaving a negatively charged particle. For positively charged toner parities, the clathrates/cryptates are covalently bound to the toner particles, and weakly associated metal cations are added with corresponding anionic species to the liquid dispersion. This way, the clathrates/cryptaes on the toner particles complex selectively with the cations, and strip them from the dispersion, creating a positively charged particle.

1 Claim, 15 Drawing Sheets

CAGE COMPLEXES FOR CHARGE DIRECTION IN LIQUID TONERS

CROSS REFERENCE TO RELATED APPLICATION

This application is a division of prior application, U.S. Ser. No. 08/345,144, filed Nov. 28, 1994, now pending and also entitled Cage Complexes For Charge Direction in Liquid Toners.

FIELD OF THE INVENTION

This invention relates generally to liquid toners for use in electrophotography (EP). More specifically, this invention relates to use of cage complex molecules for enhanced charge direction in liquid toners.

In the general field of liquid toner electrophotography it is essential to have a formal electrical charge associated with each toner particle dispersed in the carrier fluid, if the particles are to be electrostatically caused to develop on the latent image and adhere thereto. These toners must give consistently high and uniform developed image density not only on the element on which the image is initially formed, but also on the paper or other medium to which it is ultimately transferred and which is the final printed output of the printer.

Toner for liquid electrophotography (LEP) generally consists of at least four essential parts. There is always a dispersing medium, typically a hydrocarbon, silicone oil, or possibly a vegetable oil, considered the continuous phase. There must be colorant, usually supplied by a pigment or dye. There is a resin coating, also called a binder, on the pigment or dye composed of any of several common polymerizable materials, and this combination of the pigment or dye and resin coating make up the toner particle. The resin coating enhances dispersion of the pigment in the dispersing medium, and, also, the coating may be fused after the image is made to give permanence to the printed image. Lastly, toner includes some means of attaching or associating an electrical charge on the toner particle, so that the toner particle may be made to electrostatically develop on the latent image.

In dry powder electrophotography, electrical charge is easily generated on the toner particles via frictional or triboelectric charging. In liquid electrophotography (LEP), the dispersing medium is non-polar and non-conducting, which makes it impossible to charge the particles via frictional or triboelectric charging, so LEP toner particles must have a formal, relatively permanent charge associated with them. This can be achieved either through charged sites in the resin coating itself or from non-specifically adsorbed, permanently charged species in the dispersion. In addition, the charge on the toner particles must not destabilize the dispersion nor cause flocculation, and it must remain on the particle over time and under conditions of use in order to keep the bulk conductivity of the continuous phase at a low and controlled level.

BACKGROUND OF THE INVENTION

Several patents teach methods of charge direction for liquid electrophotographic toners. In general, liquid toners are attractive because they satisfy the need for smaller toner particles than dry powder electrophotographic methods can deliver. These liquid-dispersed particles, however, need to have charge more or less permanently attached to them or they will not be impelled to move across the development gap of the print engine to form the image desired.

Charging schemes for liquid electrophotography (LEP) have previously taken one of the following forms:

1. Loosely Associated, Non-specifically Adsorbed Charged Macromolecules (lecithin; Gibson et al., U.S. Pat. No. 4,897,332). Non-specifically adsorbed macromolecules such as lecithin do not give either consistent or permanent charge to the toner. They also serve to increase average particle size which tends to reduce mobility relative to a smaller particle with the same surface charge.

2. Acid-base Chemistry with the Addition of Carboxylates (K. Pearlstine, I. Page and L. El-Sayed, *Journal of Imaging Science,* Vol. 35, No 1, Jan/Feb. 1991, pp 55–58). The Pearlstine article discloses toner particles with carboxylic acid substituents as charge directors. The carboxylic acids are bound or associated with the toner particles via Van der Waals forces. This is a form of nonspecific adsorption, and is readily reversible. The carboxylic acid group can serve as an electron pair donor to an appropriately selected metal ion and thus provide charge direction for the toner particle. There is, however, a high probability that at least some of the total charge in the system is spread uniformly through the continuous phase and not localized on the toner particles.

3. Complexed Metals (8-hydroxyquinoline; Elmasry et al., U.S. Pat. No. 4,925,766. Beta-diketones; Lane, U.S. Pat. No. 5,028,508. Salicylates; Swidler, U.S. Pat. No. 5,045,425). These patents teach the use of more specific binding agents to complex the desired ion, however, they rely on mono or bidentate ligands and in general, weakly coordinating ligands such as salicylate, carboxylate, and phenol. Elmasry et al. teaches the inclusion of other complexing agents such as 8-hydroxyquinoline as monomers in the polymeric resin coating which are adsorbed onto the pigment colorant. Lane teaches the use of β-diketones as bidentate ligands. Swidler teaches substituted salicylates as examples of bidentate ligand complexing agents. These ligands typically possess oxygen or nitrogen donor atoms to donate electron pairs into the coordination sphere of a metal ion. The oxygen donor sites are most often protonated, such as in the case of carboxylic acids or phenol. The donor sites may also be non-protonated, as in the case of some nitrogen donor atoms or beta-diketones.

In these prior art approaches, the coordinating functional group does not have a high affinity for the metal ion, and the formation constant for the metal/ligand complex is low. This means that at least some, if not a large proportion, of the metal ion will not be associated with the ligating groups. Instead, metal ions will be dispersed in the continuous phase rather than located on the toner particles, thus contributing to the overall conductivity of the dispersion and, due to the greater electrophoretic mobility of the dispersed metal ions, suppressing the migration of the toner particles in the electrical field.

The use of protonated binding sites on the ligating functional groups causes another problem. When the metal is bound into the binding site, the proton with its associated charge must go somewhere else. If it goes into the continuous phase it contributes to background conductivity and serves to suppress toner particle migration in the electrical field. Also, there is residual water in virtually all toners, and the proton may go into the residual water, and, if this happens, there may be inverse micro-micellar formation which can promote flocculation of the toner. This problem is one possible explanation for the observed flocculation phenomena in this type of toner.

4. Metal Soaps (Carboxylate complexes, specifically; Elmasry et al., U.S. Pat. No. 4,925,766). This charging scheme represents a subcategory of the complexed metals above, but is mentioned separately because the soaps may simply be added separately to the toner formulation in the hope that the long aliphatic chain portion of the soap will associate via Van der Waals forces with the resin coating of the toner particle.

All liquid toners have a need for charge on toner particles dispersed in hydrocarbon medium. Liquid-dispersed toner cannot be triboelectrically charged like dry powder toners and must instead have charge that is more or less permanently associated with the toner particle. The prior art provides this charge, but does so less efficiently than the present invention.

SUMMARY OF THE INVENTION

The present invention is a way to permanently affix the formal electrical charge to the liquid toner particles without destabilizing the dispersion and while maintaining an extremely low level of excess charge in the continuous phase. This invention is the incorporation of cage complex molecules into the dispersion to provide strong coordination of a charged species such as a metal ion or charged organic molecule. The charged species will be strongly complexed with the cage complex molecules, which are also called clathrates or cryptates. The formation constants for these complexes indicate that there will be very little free charge at any time. The charge will tend to be associated approximately 100% with the desired sites and only to a negligible extent with any other binding site.

In one embodiment, the present invention calls for the addition of an unbound, strongly complexing (clathrating, cryptating) agent into the dispersion, and the construction of the toner particle to include weakly coordinating sites on its resin coating. The weakly coordinating sites may be any common ligand containing an oxygen, nitrogen, sulfur, phosphorous or other electron pair donor atom. The weakly coordinating site is ion exchanged prior to addition of the complexing agent, so that the site is weakly coordinated with the desired cation. The cation may be any metal ion or any cationic organic ion, or ammonium or alkyl, allyl or aryl substituted ammonium ions. Then, the strongly complexing cage molecule (clathrate, cryptate) is added to the dispersion and charge separation results as the cage complex molecule competes favorably for the cation and removes it from the weakly coordinating site on the surface of the toner particle, leaving the toner, in this case, negatively charged.

In another embodiment, this invention calls for the incorporation of cage complex molecules (clathrates, cryptates) into the coating of the toner particle to provide strong coordination there of a charged species, for example, a metal ion or cationic organic ion. The charged species is added into the toner dispersion in the form of a weakly complexed salt or soap. The cage molecule in the resin coating of the dispersed toner particles competes favorably for the positive ion and removes it from the salt or soap, leaving the weakly coordinating negative ion in the dispersion. Thus, charge separation is achieved with the positive charge, in this case, residing on the toner particle.

In the various embodiments of the present invention, the cation will be strongly complexed with the clathrate or cryptate. The optimum amount of cation to be added can be readily determined for each set of conditions, and the point at which excess has been added can be readily determined. The formation constants for these clathrate/cation or cryptate/cation complexes indicate that there will be very little free charge in the continuous phase at any time, provided no excess source of cation has been added.

The cage complex molecules of this invention have as an essential feature the ability, by their geometry and donor site chemistry, to encapsulate or enclose a charged ion, and to trap such an ion in a relatively permanent position. Such cage complex molecules have been known and described in the literature for some years as strongly coordinating, and they have been applied in other areas such as extraction of strategic metals from ores or waste slurries. Applicant believes this is the first disclosure of the use of such molecules in providing charge permanence for toners for liquid electrophotography (LEP).

For this invention, one may use cage complex molecules that have at least three chains, with at least one electron pair donor atom in each chain, for a total of at least three electron pair donor atoms (EPD's). Or, the cage complex molecules may have at least two connected rings, with a total of at least three EPD's in the molecule including at least one EPD in each of the connected rings. For example, in cage complex molecules having two connected rings, an EPD is located in each of the two rings, an additional EPD (ie: a third EPD) is located in either of the two connected rings, and additional EPD's (ie: beyond three) may be located in either or both of the rings. Therefore, the cage complex molecules of this invention have three or more donor atoms present which can act as electron pair donors (EPD) to coordinate (complex with) positive ions. The positive ions may be either metal ions, organic ions, ammonium ions, or alkyl, allyl or aryl substituted ammonium ions. The cage complex molecules have both steric and electrostatic interactions with the cations that greatly enhance coordination and result in very high formation constants.

In summary, in one embodiment, a liquid toner is made in which the cage complex molecules are added to the dispersion so they remove the cation from the toner particle leaving a negatively charged toner particle behind. This embodiment results in a negative charge on the toner particle that is stable and permanent. In another embodiment, a liquid toner is made in which these cage complex molecules are covalently attached to the toner particle, and they remove the cation from the dispersion, leaving a negatively charged ion in the dispersion and resulting in a positively charged toner particle. This positive charge on the toner particle is also stable and permanent.

DETAILED DESCRIPTION OF THE INVENTION

Figure 1:
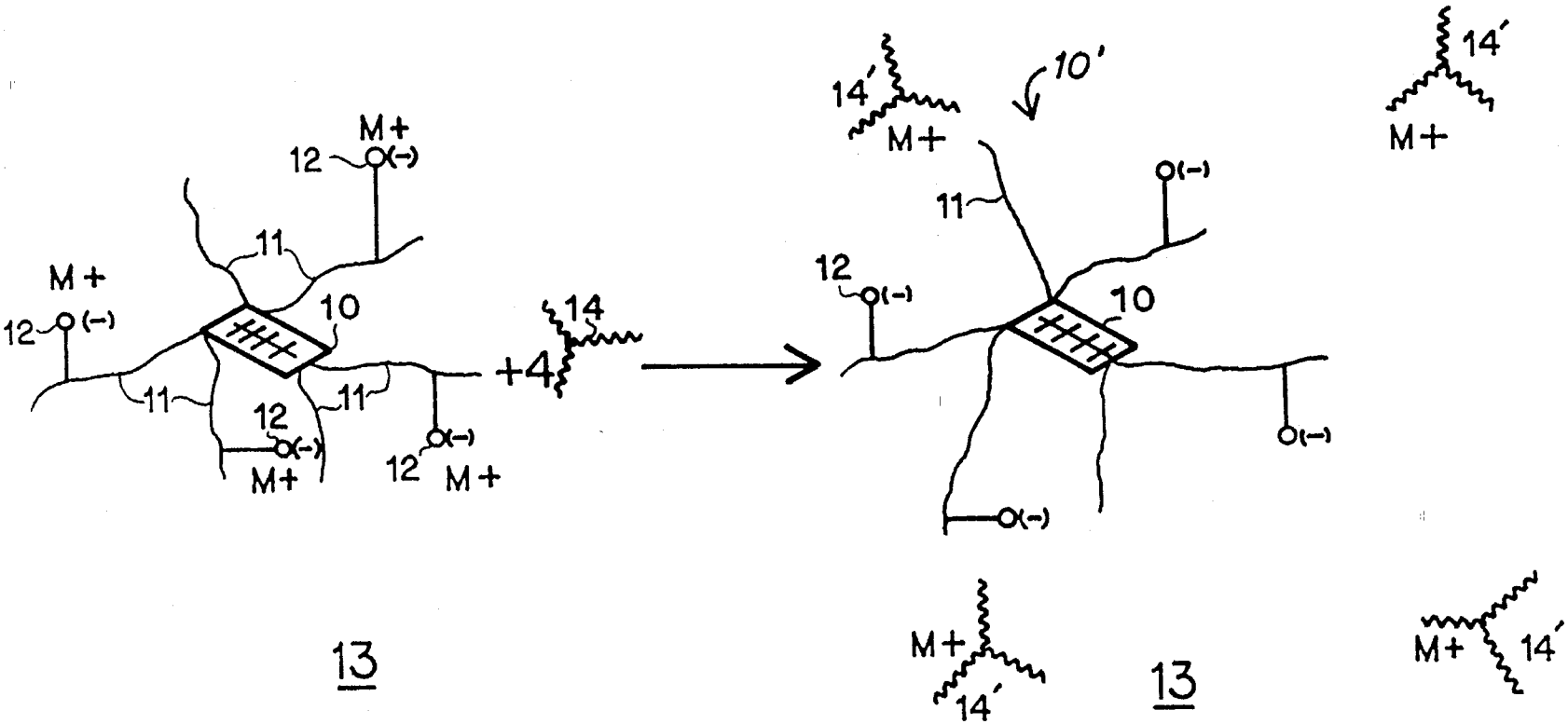
FIG. 1 is a schematic representation of one reaction for preparing a negatively charged toner particle of the invention.

Referring to the Figures, in FIG. 1 is depicted one reaction for preparing a negatively charged toner particle according to the invention. A pigment particle 10 has strands of polymeric resin 11 bound to it. In the chain of polymeric resin 11 are bound weak coordination sites 12 with a negative charge. Weakly associated with each coordination site 12 is a metal cation, M+. Pigment particle 10 with polymeric resin 11 and coordination sites 12 is dispersed in the liquid toner medium 13.

Added to toner medium 13 are, in the FIG. 1 schematic example, four (4) cage molecules 14. According to the reaction, the cage complex molecules 14 selectively complex with the metal cations, M+, and strip M+ from the toner particle 10, leaving a negatively charged toner particle 10'. The cage molecules 14', with the complexed metal cations, become distributed in the liquid toner medium 13.

Figure 2:
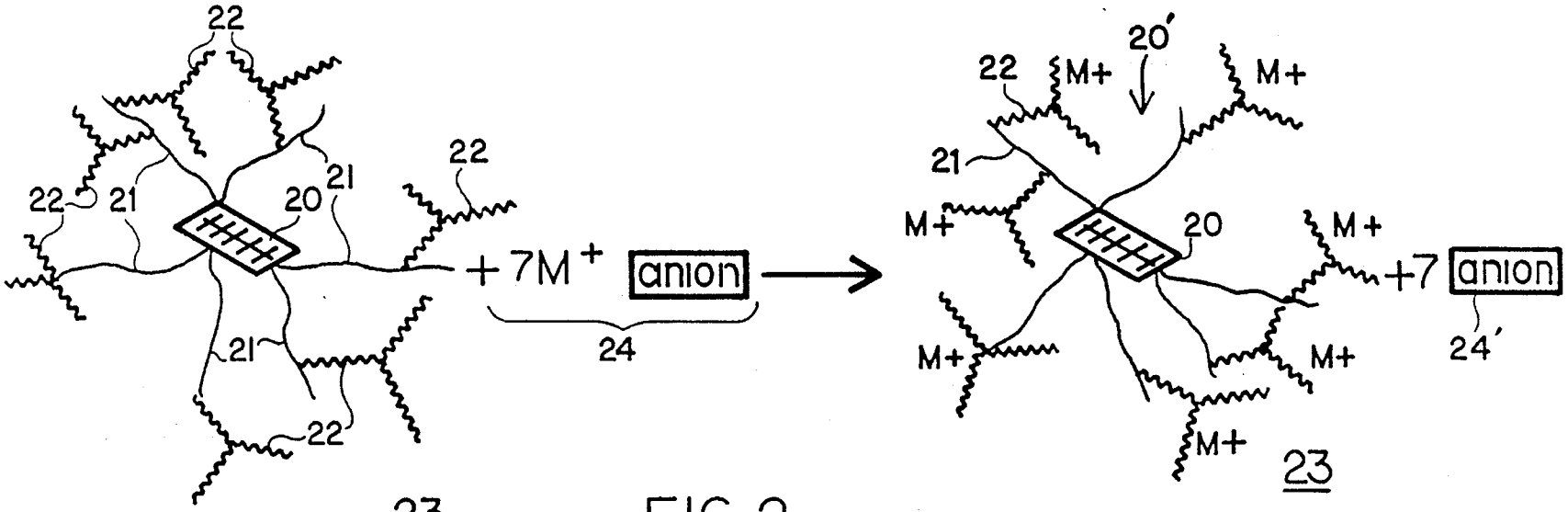
FIG. 2 is a schematic representation of one reaction for preparing a positively charged toner particle of the invention.
Figure 3A:
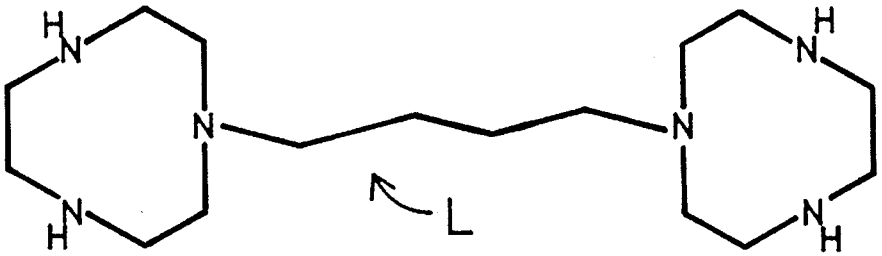
FIGS. 3–8 are schematic examples of some of the cage complex molecules of the invention.
Figure 3B:
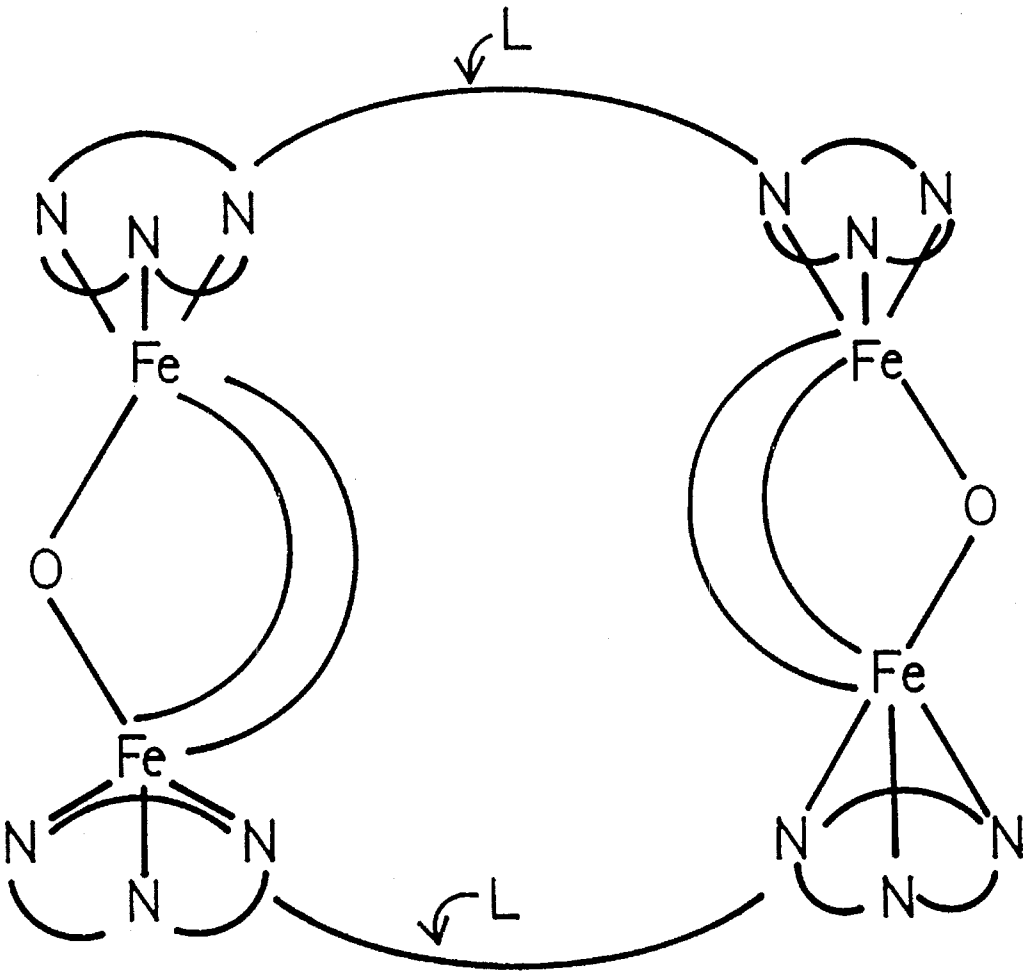

In FIG. 2 is depicted one reaction for preparing a positively charged toner particle according to the invention. A pigment particle 20 has strands of polymeric resin 21 bound to it. In the chain of polymeric resin 21 are bound cage molecules 22. The cage molecules 22 may also be included in the chain in a side group pendent to the chain. Pigment particle 20 with polymeric resin 21 and cage molecules 22 is dispersed in the liquid toner medium 23.

Added to the toner medium 23 are, in the FIG. 2 schematic example, seven (7) ionic molecules 24, each containing cation M+ and an anion. According to the reaction, the cage molecules 22 selectively complex with the metal cations, M+, and strip M+ from the dispersion, creating a positively charged toner particle 20'. The seven anions 24', without the metal cation M+, remain distributed in the liquid toner medium 23.

The toner medium, as a carrier liquid for the liquid toner dispersions of the invention, has an electric resistance of at least $10^2$-Ωcm and a dielectric constant of not more than 3.5. Exemplary carrier liquids include straight-chain or branched-chain aliphatic hydrocarbons and the halogen substitution products thereof. Examples of these materials include octane, isooctane, decane, isodecane, decalin, nonane, dodecane, isododecane, etc. Such materials are sold commercially by Exxon Co. under the trademarks: Isopar®-G, Isopar®-H, Isopar®-K, Isopar®-L, Isopar®-V. These particular hydrocarbon liquids are narrow cuts of isoparaffinic hydrocarbon fractions with extremely high levels of purity. High purity normal paraffinic liquids such as the Norpar® series of products sold by Exxon may also be used. These materials may be used singly or in combination. It is presently preferred to use Norpar®-12.

The pigment components of the toner particles are well known. For instance, carbon blacks such as channel black, furnace black or lamp black may be employed in the preparation of black developers. One particularly preferred carbon black is "Mogul L" from Cabot. Organic pigments, such as Phthalocyanine Blue (C.I. No. 74 160), Phthalocyanine Green (C.I. No. 74 260 or 42 040), Sky Blue (C.I. No. 42 780), Rhodamine (C.I. No. 45 170), Malachite Green (C.I. No. 42 000), Methyl Violet (C.I. 42 535), Peacock Blue (C.I. No. 42 090), Naphthol Green B (C.I. No. 10 020), Naphthol Green Y (C.I. No. 10 006), Naphthol Yellow S (C.I. No. 10 316), Permanent Red 4R (C.I. No. 12 370), Brilliant Fast Pink (C.I. No. 15 865 or 16 105), Hansa Yellow (C.I. No. 11 725), Benzidine Yellow (C.I. No. 21 100), Lithol Red (C.I. No. 15 630), Lake Red D (C.I. No. 15 500), Brilliant Carmine 6B (C.I. No. 15 850), Permanent Red F5R (C.I. No. 12 335) and Pigment Pine 3B (C.I. No. 16 015), are also suitable. Inorganic pigments, for example Berlin Blue (C.I. No. Pigment Blue 27), are also useful. Additionally, magnetic metal oxides such as iron oxide and iron oxide/magnetites may be used. Any colorant in the *Colour Index*, Vols. 1,2, 6 and 7 may be used as the pigment component.

As is known in the art, binders are used in liquid toner dispensers to fix the pigment particles to the desired support medium such as paper, plastic film, etc., and to aid in dispersing the pigment charge. The binder is also known as the polymeric resin coating, or resinous carrier. The binders may comprise thermoplastic or thermosetting resins or polymers such as ethylene vinyl acetate (EVA) copolymers (Elvax® resins, DuPont), varied copolymers of ethylene and α, β-ethylenically unsaturated acid including (meth) acrylic acid and lower alkyl ($C_1$–$C_{18}$) esters thereof, and polymers of other substituted acrylates. Copolymers of ethylene and polystyrene, and isostatic polypropylene (crystalline) may also be used. Both natural and synthetic wax materials may also be used. A preferred resin is a block copolymer having both long and short chain acrylates.

In one embodiment, the polymeric resin coating is constructed to include weakly coordinating sites on or in it. The weakly coordinating sites may be any common ligand containing an oxygen, nitrogen, sulfur, phosphorous or other electron pair donor atom (EPD). The coordinating sites may be made on the resin polymer by any conventional method. Examples of preferred coordinating sites are "weakly" associating groups such as carboxylates, quinolinates or sulfonates, for example.

The combination of pigment particle 10, polymeric resin 11 and coordination sites 12 in FIG. 1 make up what is referred to as the toner particle. In FIG. 2, the toner particle is the combination of pigment particle 20, polymeric resin 21 and bound cage molecules 22.

The cation may be any metal ion or any cationic organic ion, ammonium ion, or alkyl, allyl or aryl substituted ammonium ion. The cation may be selected from the list of K+, Na+, $Ca^{2+}$ $Al^{3+}$, $Zn^{2+}$, $Zr^{4+}$, $Mg^{2+}$, $NH_{4+}$, and $RNH_{3+}$, $R_2NH_{2+}$, $R_3NH$+ and $R_4N$+, where R is any alkyl, allyl or aryl group, for example.

In one embodiment, for negatively charged toner particles, the metal cation may be ion-exchanged to be weakly coordinated with sites on the resin coating. In another embodiment, for positively charged toner particles, the metal cation may be added to the dispersion while combined with any suitable counter anion, for example, salts or soaps. Preferred cation-counter anion combinations are calcium, zirconium (IV), or aluminum carboxylate, where the carboxylate is from 5–20 carbons in chain length.

The cage complex molecules are strong chelating or complexing agents. They have the ability to encapsulate or enclose a metal cation, and to trap such an ion in a relatively permanent position. The cage complex molecules of this invention have at least three (3) chains or at least two (2) connected rings, and have at least one donor atom in each chain, or at least one donor atom in each of the connected rings plus at least one additional donor atom in either of the two connected rings, for a total of at least three donor atoms in each cage complex molecule. This way, three or more donor atoms, which herein are also called electron pair donors (EPD), are present in the cage molecule to coordinate (complex) with the metal cation. The cage molecules have both steric and electrostatic interactions with the cation that greatly enhance coordination and result in very high formation constants for the cage molecule/cation complex, typically, at least $10^3$.

Specific examples of cage complex molecules of the invention are illustrated in FIGS. 3–8. FIG. 3A schematically depicts the clathrate "L" described by J. L. Sessler, J. W. Sibert and V. Lynch, and FIG. 3B schematically depicts two molecules of the clathrate "L", $L_1$ and $L_2$, complexing two molecules of $Fe_2O$ $[LFe_2O(O_2CCH_3)_2]^{4+}$, described by J. T. Markert and C. L. Wooten at *Inorg. Chem.*, 1993, 32, 621–626. As illustrated by FIG. 3B, it is probable that during the practice of this invention, a cation may be complexed simultaneously with more than one cage complex molecule, and likewise, a cage complex molecule may be simulteneously complexed with more than one cation.

Figure 4A:
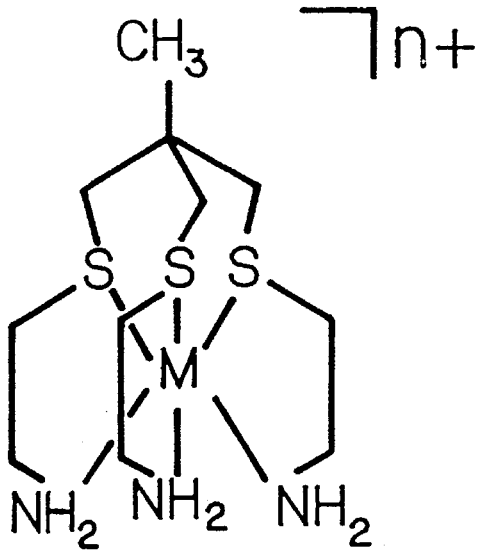
Figure 4B:
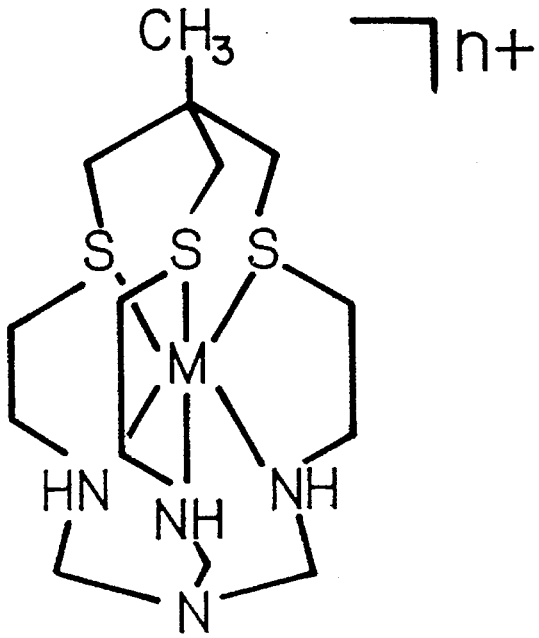
Figure 4C:
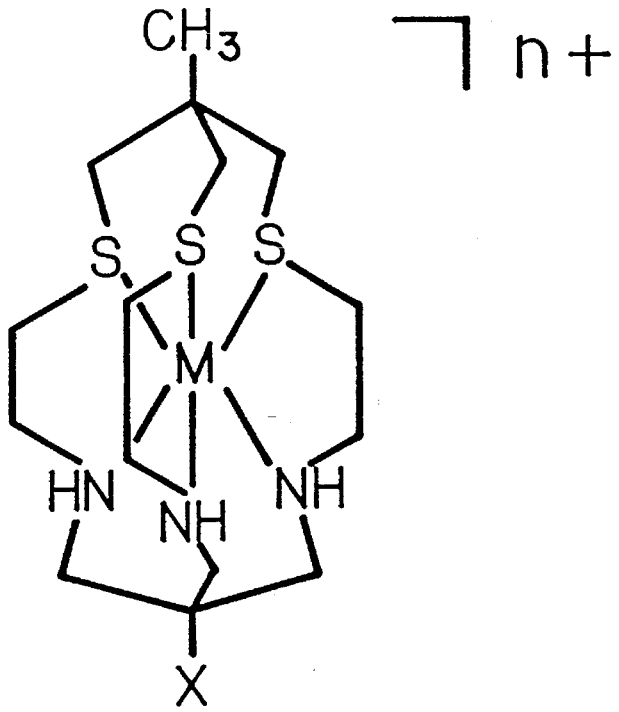
Figure 4D:
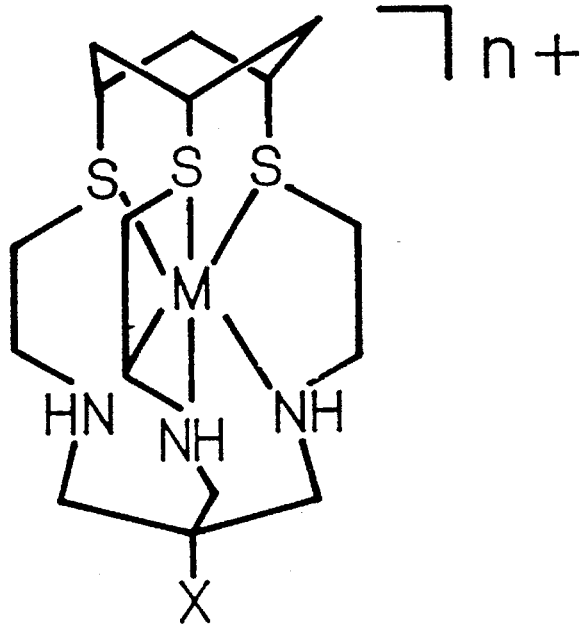
Figure 4E:
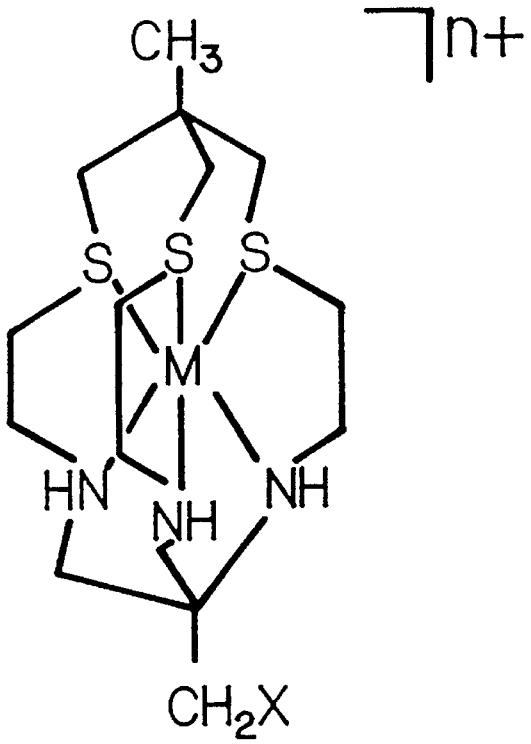
Figure 4F:
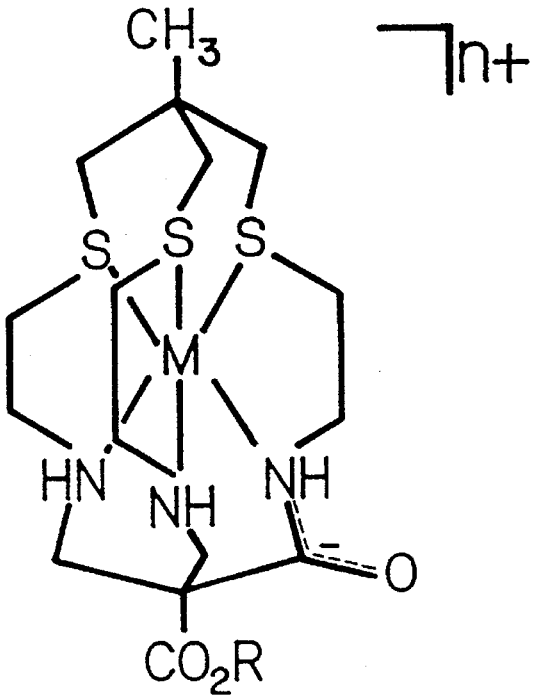
Figure 4G:
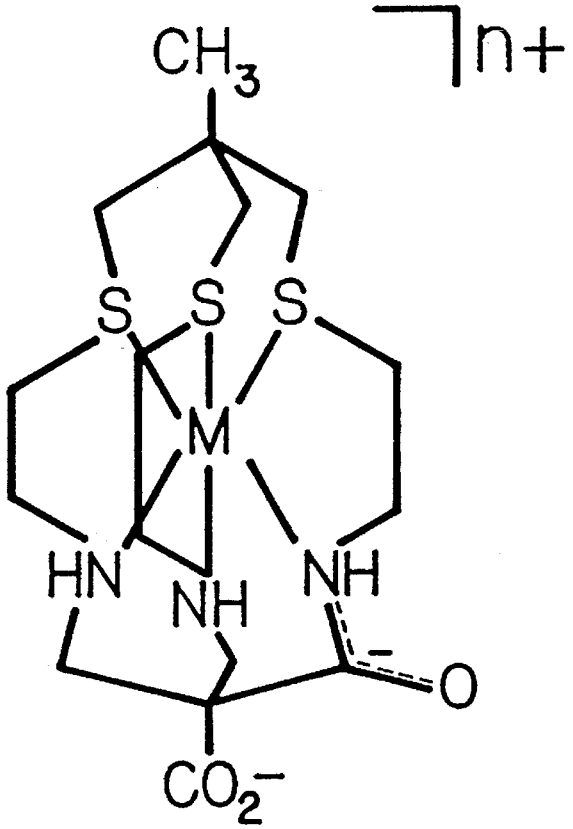

FIGS. 4A–4G schematically depict 13 clathrates described by P. A. Lay, J. Lydon, A. W. H. Mau, P. Osvath, A. M. Sargeson and W. H. F. Sasse at *Aust. J. Chem.*, 1993, 46, 641–661. In FIGS. 4A–4G, "M" represents a selected metal or cation which is chelated or complexed by the cage molecule. In the article, "M" is cobalt (Co), however, "M" for this invention may be other metals or cations. The charge, n+, of the cage molecule/metal or cation complex is determined by the charge of the metal or cation. Before these clathrates complex with a cation, no "M" or n+ is present, as depicted in the claims. FIG. 4A is clathrate #1 from the article, and FIG. 4B is clathrate #2. FIG. 4C is #3 from the article when X=$NO_3$, #4 when X=$NH_{3+}$, #5 when X=Cl, #6 when X=OH and #7 when X=H. Also, X may be any alky, aryl or allyl group for different embodiments of this form of the invention. FIG. 4D is clathrate #8. Also, X may be any alkyl, aryl or allyl group for different embodiments of this form of the invention. FIG. 4E is #9 when X=Cl, and #10 when X=OH. Also, X may be any alkyl, aryl or allyl group for different embodiments of this form of the invention. FIG. 4F is clathrate #11 when R=Et, and #12 when R=H. FIG. 4G is clathrate #13 from the article.

Figure 5A:
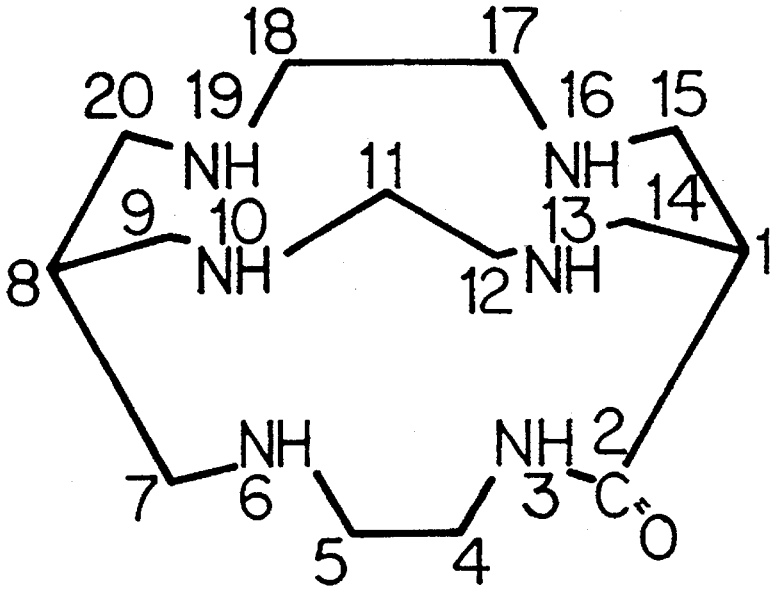
Figure 5B:
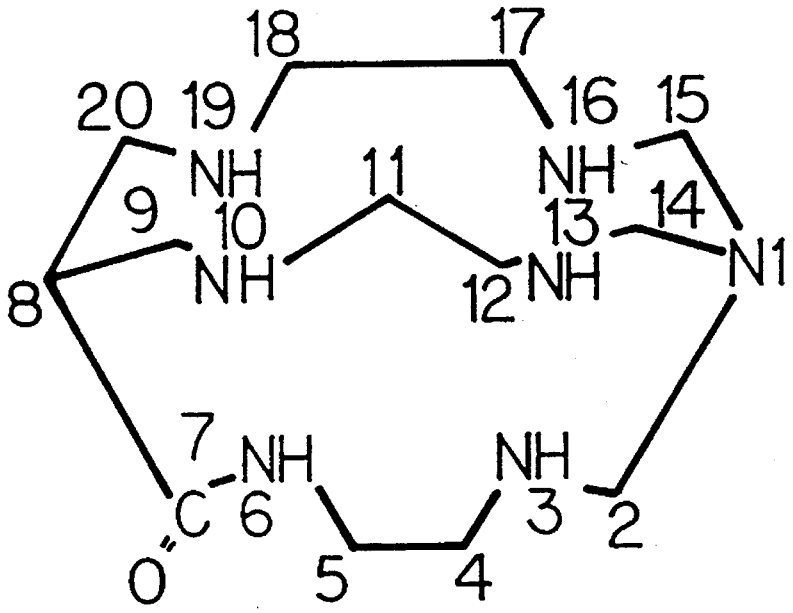
Figure 5C:
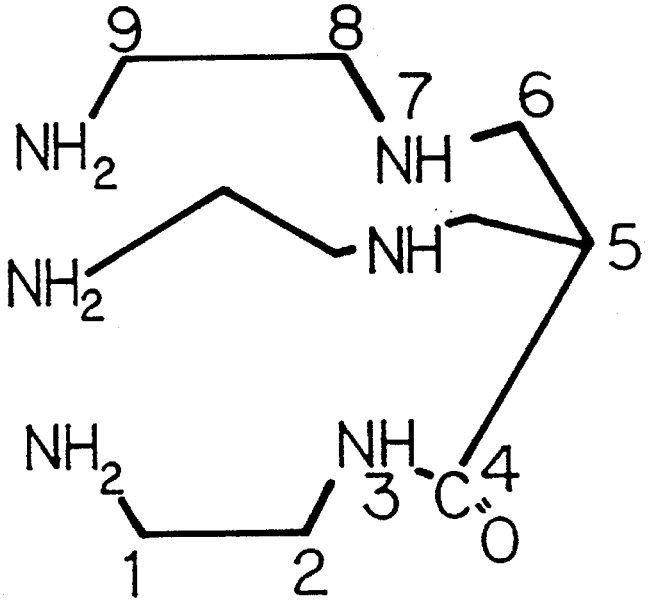
Figure 6A:
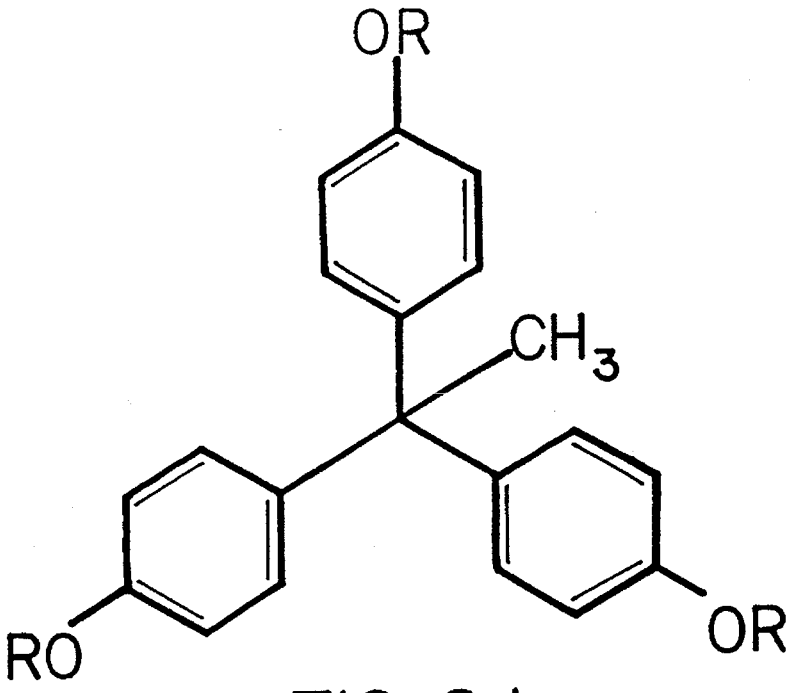
Figure 6B:
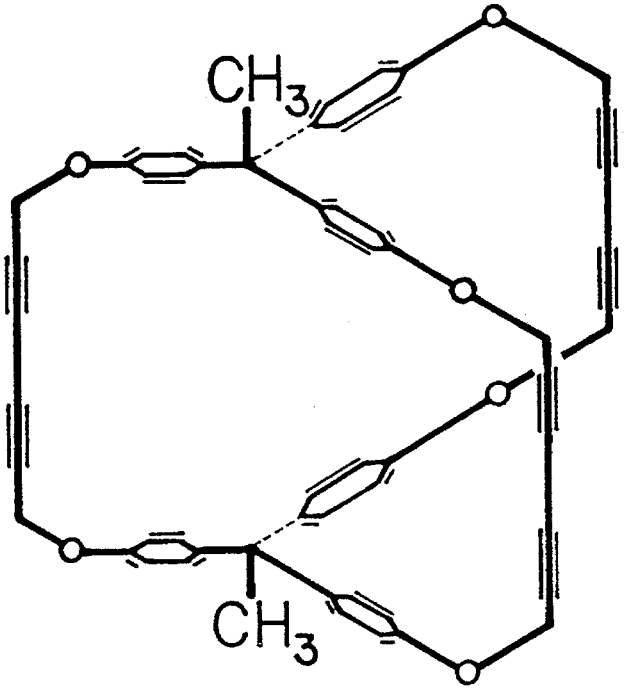
Figure 7A:
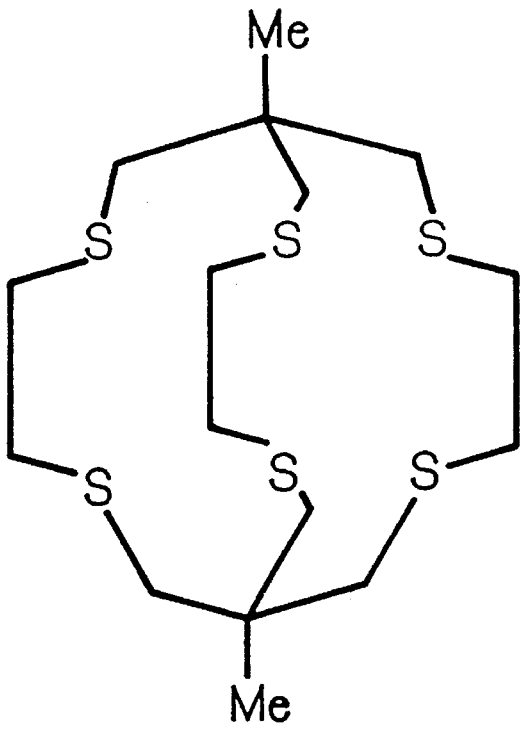
Figure 7B:
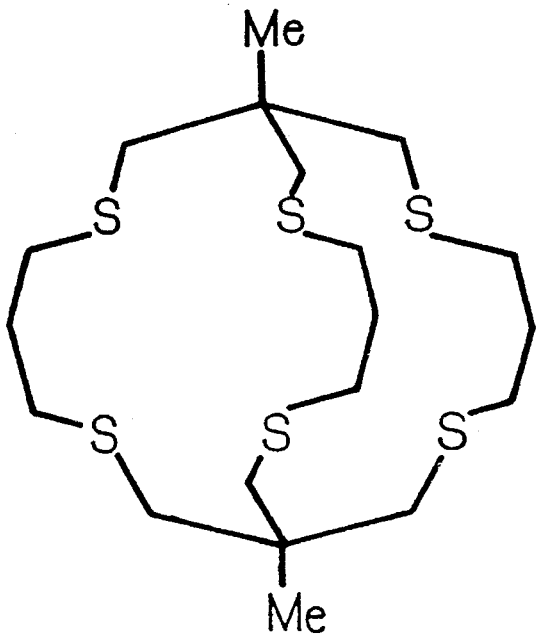

FIG. 5A schematically depicts the clathrate "oxosar", FIG. 5B depicts "azaoxosar", and FIG. 5C depicts "oxosen" described by R. J. Geue, W. R. Petri, A. M. Sargeson and M. R. Snow at *Aust. J. Chem.*, 1992, 45, 1681–1703. FIGS. 6A and 6B schematically depict three clathrates described by D. O. Krongly, S. R. Denmeade, M. Y. Chang and R. Breslow at *J. Amer. Chem. Soc., 1985,* Vol. 107, No. 19, 5544–45. In FIG. 6A, clathrate #1 from the article is when R=$CH_3$, and #2 is when R=$CH_2C$=CH. FIG. 6B is clathrate #3 from the article. FIGS. 7A and 7B schematically depict two (2) clathrates described by P. Osvath and A. M. Sargeson at *J. Chem. Soc.*, Chem Commun., 1993, 40–42.

Figure 8A:
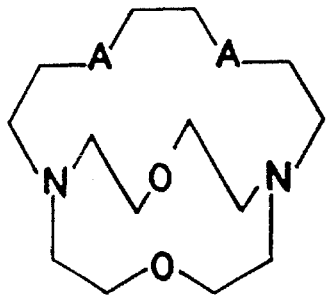
Figure 8B:
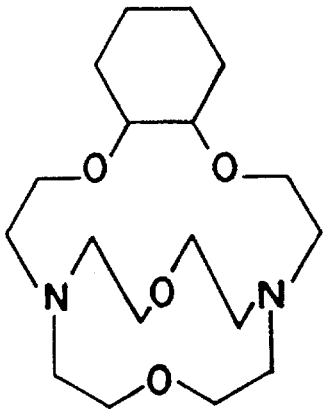
Figure 8C:
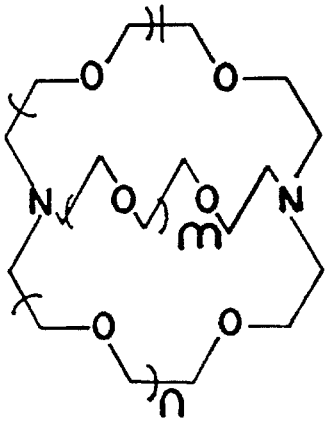
Figure 8D:
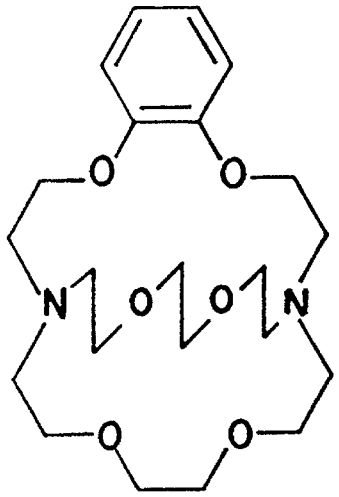
Figure 8E:
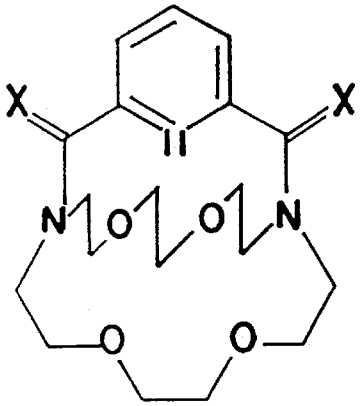
Figure 8F:
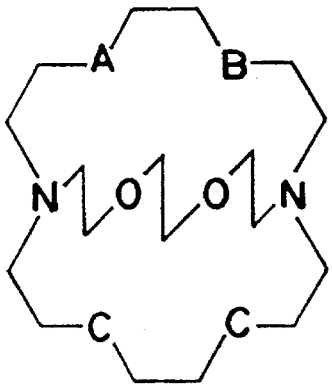
Figure 8G:
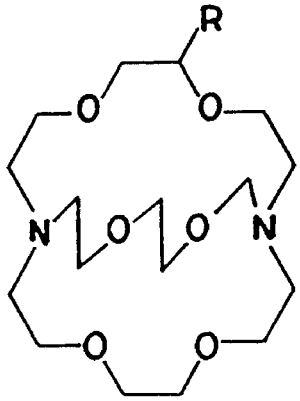
Figure 8H:
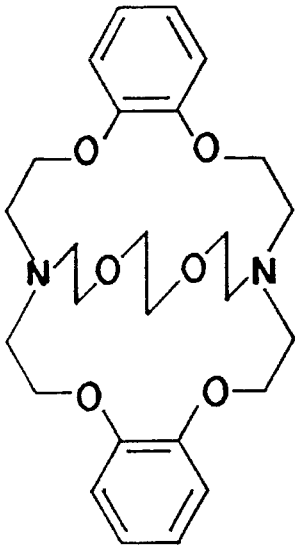
Figure 8I:
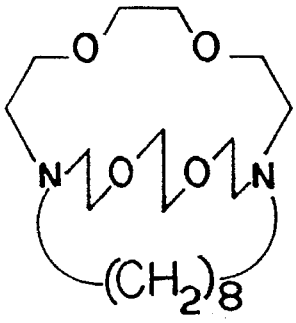
Figure 8J:
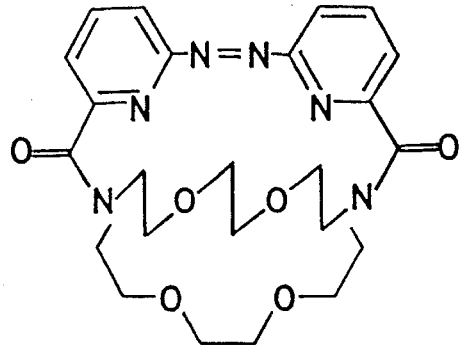
Figure 8K:
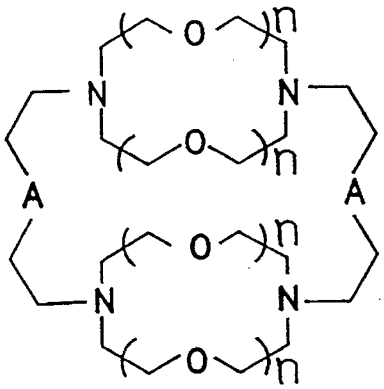
Figure 8L:
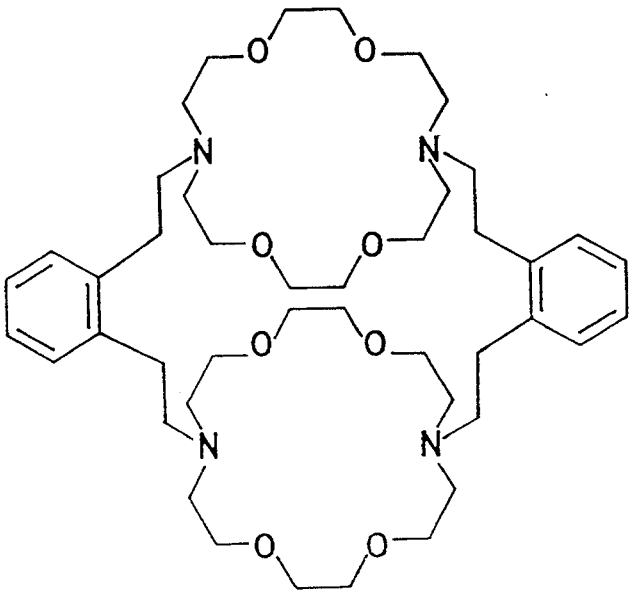
Figure 8M:
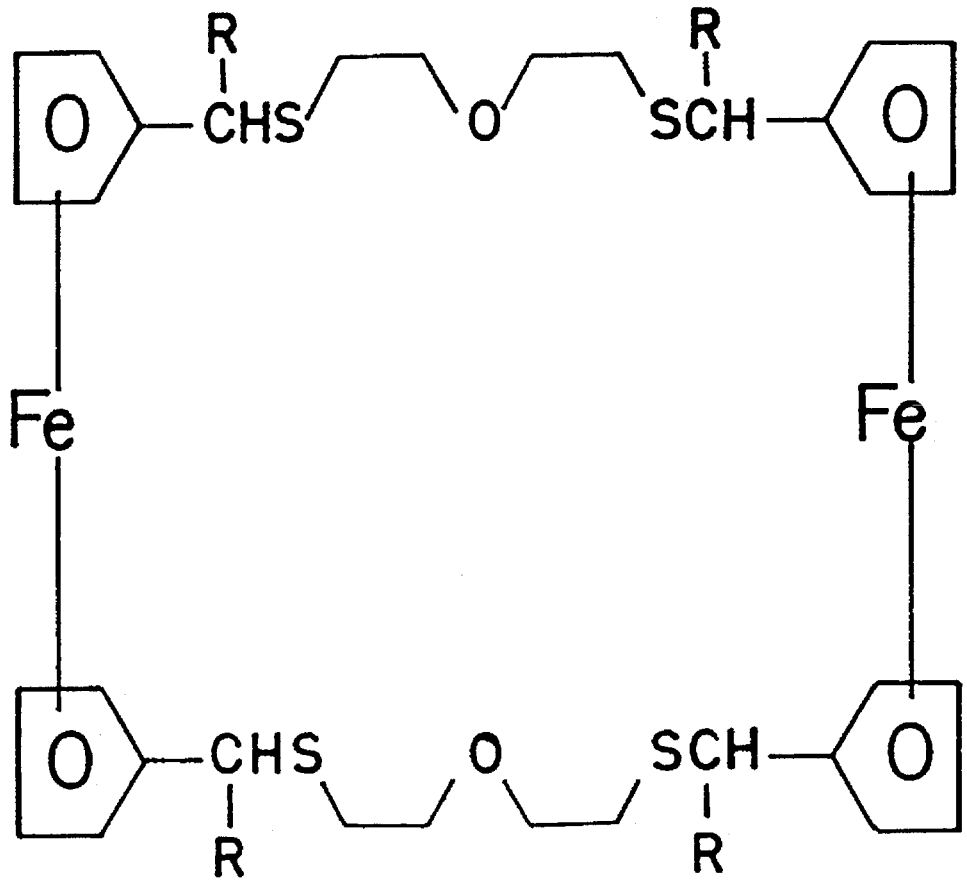

FIGS. 8A–8M schematically depict 13 types of clathrates described in Charts XI and XII by R. M. Izatt, J. S. Bradshaw, S. A. Nielsen, J. D. Lamb, J. J. Christensen and D. Sen at *Chem, Rev.* 1985, 85, pp. 271–339. From this article, in FIG. 8A, "A" may be O, NH or $NCH_3$. In FIG. 8C, "l,m,n" may be 0, 1, or 2. In FIG. 8E, "X" may be O or $CH_2$ or any alkyl, aryl, or allyl group. In FIG. 8F, "A" may be $NCH_3$ or NH, "B" may be O, NH or $NCH_3$, and "C" may be O or $NHC_3$. In FIG. 8G, R=any alkyl, aryl, or allyl group. In FIG. 8K, "A" may be O or $(CH_2)_5$, and "n" may be 1 or 2. In FIG. 8M, "R" may be H or $CH_3$.

These cage complex molecules may be made by the techniques disclosed by the above authors. In one embodiment of the invention wherein the unbound cage complex molecule is uniformly distributed throughout the dispersion, it is preferably used in the saturated, nitrogen donor form. In another embodiment of the invention, wherein the cage complex molecule is bound to the resin coating of the toner particle, it is preferably included in the resin polymer by covalent bonding. So prepared, the liquid toner of this invention may be used similarly to other, conventional liquid toners.

The cage complex molecules described above may also be present in variations wherein the oxygen (O), nitrogen (N), or sulfur (S) atoms depicted in the FIGS. 3–8 may be substituted by other electron pair donor (EPD) atoms, such as phosphorous (P), arsenic (As) or selenium (Se). Therefore, the term "EPD" may be substituted into the Figures in place of O, N, or S, and O, N, S, P, As or Se, or other donor atoms, may be substituted for "EPD", and still be within the scope of this invention, provided the valence and bonding requirements of the "EPD" are met with H or alkyl, aryl or allyl groups. This substitution of "EPD" into the schematic examples represented by the Figures serves to generalize the Figures to illustrate the scope of this invention. Therefore, other cage complex molecules, besides those specifically depicted in FIGS. 3–8, may also be used and still be within the scope of the present invention.

The cage complex molecules for this invention, then, may be described generally as follows:

For cage complex molecules with three (3) chains:

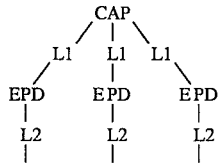

(1)

where CAP=C, N or P, or any ring of 3 or more atoms; where -L1-EPD-L2- is termed a "chain"; where the links (L1) between the CAP and the EPD's are $(CH_2)_q$ where q=0–20; and where the other links (L2) from the EPD's are $[(CH_2)_r EPD]_s$ where r=1–18, and s=0–9 or, alternatively, L2 may be H, alkyl, aryl, or allyl groups. This way, the links in the chains, indicated by the $(CH_2)_q$ groups and the $(CH_2)_r$ groups, are 0–20 atoms long. Also, this way there may be 1–10 EPD atoms per chain. If the total length of each chain is more than 20 atoms, less specificity of chelation with the ion will be encountered.

The atoms that make up the CAP in Formula 1 may also be bonded to H, alkyl, aryl or allyl groups to satisfy their valence and bonding requirements. Two or more of the links (L2) from the EPD's may also be connected at their second, or terminal, ends by another CAP, which may also be bonded to H, alkyl, aryl or allyl groups. Alternatively, two or more of the links (L2) may be bonded to each other at their terminal ends.

For cage complex molecules with two (2) connected rings:

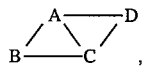

(2)

or

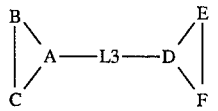

(3)

In Formula 2, each ring (A-B-C, A-C-D) is any closed loop of any number of bonded atoms, and the two loops share a common side (A-C). In Formula 2, at least three of A,B,C,D include an electron pair donor (EPD), so that each of the two rings contains at least one EPD and the two rings contain a total of at least three EPD's.

In Formula 3, at least one of A, B, C and at least one of D,E,F are EPDs, and, in addition, there is at least a third EPD in either of the two connected rings. Each ring (A-B-C, D-E-F) is any closed loop of any number of bonded atoms. The rings of Formula 3, which do not share a common side, are joined by a link (L3) of 2–20 atoms, preferably 5–6 atoms. If L3 is more than 20 atoms long, less specificity of chelation with the ion will be encountered. L3 may include a chain of $(CH_2)_t$ where t=2–20.

The following Examples illustrate the making and using of liquid toners according to the present invention:

EXAMPLE 1

Clathrating Agent in the Dispersion (Negatively Charged Toner Particles)

a. Preparation of the Polymeric Resin

A block co-polymeric resin is prepared by free radical methodology using first hexylmethacrylate to make polyhexylmethacrylate. This simple polymer is then further reacted with a mixture of laurylmethacrylate monomer and carboxylated laurylmethacrylate monomer, forming a block co-polymer in which the final composition is 20% hexylmethacrylate, 70% laurylmethacrylate and 10% carboxylic acid-substituted laurylmethacrylate. Chain lengths are controlled so that the glass transition of the final polymer is between 20° and 40° C.

b. Ion Exchange of the Weakly Coordinating Site

The polymeric resin, above, now contains carboxylated laurylmethacrylate monomer which can undergo ion exchange. The polymeric resin solution is brought into contact with an aqueous solution of potassium hydroxide, 8<pH<12.5, and a saponification reaction is allowed to proceed until a stoichiometric yield is achieved, as determined by pH measurement of the aqueous solution.

c. Construction of the Toner Particles with Weakly Coordinating Sites

Two (2) grams of very finely ground Pigment Red 81 is dispersed in 92 grams dodecane and six (6) grams of the polymeric resin (which has already been dispersed in the dodecane). This mixture is agitated for, typically, 24 hours or until a relatively stable dispersion has formed.

d. Addition of Clathrating Agent to the Dispersion

The clathrating agent:

(4)

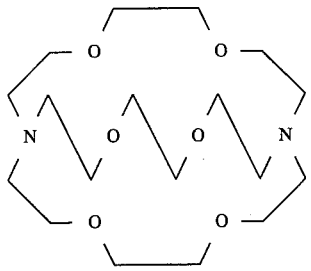

is blended into the dispersion of step c, in a 1:500 mass ratio, resulting in a final toner dispersion having approximate mass composition as follows:

| | |
|---|---|
| pigment | 2% |
| resin | 6% |
| charge director | 0.5% |
| dodecane | 91.5% |

e. Observations

Toner particles thus prepared can be plated onto an electrode having positive polarity. The conductivity of the resulting toner dispersion is greater than the conductivity of the dodecane alone or of the mixture before the clathrating agent is added. FTIR data of the clathrate solution alone shows peaks consistent with ether oxygen. FTIR data of the final toner dispersion shows peaks consistent with coordination of potassium to the ether oxygen atoms in the ring. When the toner thus prepared is ultra-centrifuged to remove the toner particles, the conductivity of the supernatant is very low.

EXAMPLE 2

Clathrating Agent on the Toner Particles (Positively Charged Toner Particles a. Construction of Toner Particles with Incorporated Clathrating Agent

Two (2) grams of very finely ground Pigment Red 81 are blended into 98 grams of a resin solution in dodecane. The resin solution has been previously prepared to consist of six (6) grams of polymeric resin and 92 grams of dodecane.

The polymeric resin is prepared using customary free radical procedures, by co-polymerizing 30% by weight hexylacrylate, 60% by weight laurylmethacrylate, and 10% by weight clathrate-substituted laurylmethacrylate. The clathrate-substituted laurylmethacrylate is:

(5)

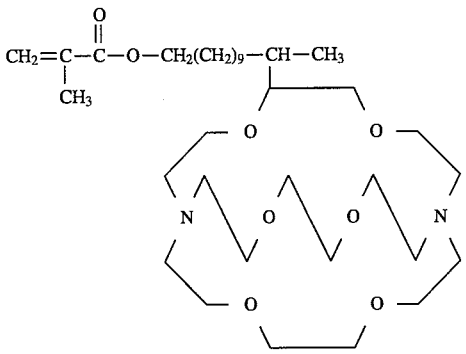

b. Addition of the Charged Species to the Dispersion

A stoichiometric amount of potassium stearate, 0.316 grams, is added to the toner dispersion above, and the resulting mixture agitated for, typically, 24 hours, or until a relatively stable dispersion has formed.

c. Observations

Immediately on addition of the metal soap to the toner dispersion, the conductivity rises to a relatively high level which is stable after about 24 hours. The final conductivity is greater than the dispersion conductivity prior to the addition of the soap. Toner particles can be plated onto a negative polarity electrode. FTIR data of the toner dispersion shows changes in the ether oxygen peaks consistent with complexation to potassium. When the toner thus prepared is ultra-centrifuged to remove the toner particles, the conductivity of the supernatant is very low. These observations are consistent with the addition of a substance that lends itself to immediate charge separation, followed by the complexation of one of the charged ions.

Some expected advantages of using the toner of this invention are:

1. Permanence of Charge on Particle

This invention teaches the incorporation of cage complex molecules into the dispersion or onto the coating of the toner particle to provide strong coordination of a charged species such as a metal ion or charged organic molecule. The charge will be strongly complexed with the cage complex molecule (clathrate, cryptate). The formation constants for these complexes indicate that there will be very little free charge at any time. The charge will, to a first approximation, be associated ~100% with the desired sites and only to a negligible extent to any other binding site.

2. Low Background Conductivity

This invention greatly reduces or eliminates background conductivity in the liquid toner dispersion by reducing or eliminating charge carriers not directly associated with the colorant toner particle. Because there is less free phase charge (charge not bound to or directly associated with the toner particles) there is lower continuous phase conductivity. This increases the electrical field maintained across the development gap without having to employ higher bias potentials. This way, toner particles will experience greater force impelling them across the development gap. The same bias potential will impel more particles across the gap, improving optical density of the printed image. Alternatively, lower bias potentials will generate comparable fields.

3. Safety of the Printer

Since the same amount of development will occur at lower bias potentials, the printer can be made safer to operate.

4. Decreased Cost Per Package

In one embodiment, the addition of the neutral clathrating agent into the toner dispersion causes the positive metal ion or organic cation to be removed from the resin binding site via competitive coordination. This leaves a permanently attached (covalently bound) negative charge on the resin coating of the toner particle. Because virtually all of the charge in the dispersion is thus either permanently bound to the resin coating or into the clathrate as a counter ion, less charge director needs to be added to the toner, overall, saving in cost of making the toner.

In another embodiment, all the positive charge is added directly to and strongly complexed with the clathrating sites on the resinous carrier. With such favorable thermodynamics, less charge director need be added to the toner, saving in the cost of making the toner.

In addition, cost is further reduced because the energy consumption and operating cost of the printer can be decreased. See points 2 and 3, above.

5. Improved Stability and Longer Storage Life

Charge on particles will not vary over time and the electrostatic stabilization provided by the charge on the particles will also not be time dependant. This means toners will have longer storage life and will not settle irreversibly in the printer at times when there is a prolonged period of disuse.

6. Independence of Toner Performance Parameters on Pigment

There are sites on many pigments that tend to coordinate or bind charged species such as metal ions. In all but the encapsulated toners these sites are exposed to some degree and charge director binding does occur at them. Because they depend on the pigment chemistry and are different from one pigment to the next, differential charging is observed in most 3- and 4-color toner sets.

The present invention uses chelates/clathrates/cryptates that bind very strongly and compete aggressively for the charging ion. The formation constants of the desired complexation are much larger than formation constants of the incidental and uncontrolled complexation with sites on the pigments. In one embodiment, this ensures that negative charging of the toner particle will occur at the intended sites (the weakly coordinating anion which was built into the polymeric resin) and will not be favored by some pigments over others. In another embodiment, positive charging of particles will occur preferentially at the covalently-bound clathrating sites because the weakly coordinating sites on exposed pigment surfaces will not compete as strongly as the cage molecules for the cations. Exposed active binding sites on pigments will not play a significant role in the overall charging characteristics of the toners. All the pigments in a set will be able to charge to a similar level. Thus, they will exhibit similar development tendencies in the printer.

7. Choice of Using Lower Concentration Toners

More efficient charging of the toner particles means that greater printed optical densities can be achieved at lower toner concentrations. This reduces both the real cost of manufacturing the toner and the cost to the consumer, of consumables.

8. Faster Print Times (Greater Printer Throughput)

For a given concentration, desired optical densities can be achieved in shorter residence times in the development gap. This means printing can be done faster, increasing the throughput of the printer in terms of pages per minute. These advantages are all realized by the more permanent and localized attachment of the charge to the toner particle, which is accomplished by this invention.

For this application, "association" means correlation due to permanent opposite polarities or charges, for example, as in anions and cations in solution. "Complexing" means the same as "coordinating" which means combination resulting from plural shared electrons originating from the same atom, for example, as in an ion-exchange resin selective for metals. "Chelation" means the same as "clathration", and same as "cryptation", which means complexation or coordination from multiple donor atoms, such as nitrogen, sulfur and oxygen, in the same molecule. "Covalent" means combination resulting from plural shared electrons originating from different atoms, for example, as in simple hydrocarbons. "Ionic" means combination resulting from the transfer of one or more electrons from one atom to another, for example, as in metal salts. "Van der Waals force" means combination resulting from a fluctuating dipole moment in one atom which induces a dipole moment in another atom, causing the two dipoles to interact. The term "weakly coordinated" means the equilibrium constant $K_f$ of the coordination product is less than or equal to $10^2$. The term "strongly chelating" or complexing means the equilibrium constant $K_f$ of the complex product is greater than or equal to $10^3$.

While there are shown and described the present preferred embodiments of the invention, it is to be distinctly understood that this invention is not limited thereto but may be variously embodied to practice within the scope of the following claims.

What is claimed is:

1. A method for making a negatively-charged toner which comprises:

constructing toner particles to include weakly coordinating sites on their resin coating;

ion-exchanging said weakly coordinating sites with cations, said cations being selected from the group consisting of: a cationic organic ion, an ammonium ion, or an alkyl, allyl, or aryl substituted ammonium ion;

dispersing said ion-exchanged toner particles in a non-polar, non-conducting liquid medium; and adding cage complex molecules to the said liquid medium to remove said cations from said weakly coordinating sites to result in negatively-charged toner particles dispersed in said liquid medium, said case complex molecules comprising a case complex molecule comprising at least three (3) chains or at least two (2) connected rings, the case complex molecule having at least three electron pair donor atoms, including at least one of the said electron pair donor atoms being located in each of the chains or at least one of the said electron pair donor atoms being located in each of the connected rings.

* * * * *